US010514642B2

(12) United States Patent
Horie

(10) Patent No.: US 10,514,642 B2
(45) Date of Patent: Dec. 24, 2019

(54) IMAGE FORMING APPARATUS

(71) Applicant: KYOCERA Document Solutions Inc., Osaka (JP)

(72) Inventor: Akira Horie, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 16/260,333

(22) Filed: Jan. 29, 2019

(65) Prior Publication Data

US 2019/0235430 A1 Aug. 1, 2019

(30) Foreign Application Priority Data

Jan. 31, 2018 (JP) ..... 2018-015087

(51) Int. Cl.
*G03G 15/00* (2006.01)
*G03G 21/16* (2006.01)

(52) U.S. Cl.
CPC ..... *G03G 15/5004* (2013.01); *G03G 15/80* (2013.01); *G03G 21/1633* (2013.01)

(58) Field of Classification Search
CPC . G03G 15/5004; G03G 15/80; G03G 21/1633
See application file for complete search history.

(56) References Cited

U.S. PATENT DOCUMENTS 6,151,455 A * 11/2000 Mikami ..... G03B 15/05 396/205
2002/0127028 A1* 9/2002 Amano ..... G03G 15/5004 399/88
2007/0104495 A1* 5/2007 You ..... G03G 15/55 399/9
2015/0234339 A1* 8/2015 Nakamura ..... G03G 21/1619 399/107

FOREIGN PATENT DOCUMENTS

JP 11017987 A * 1/1999
JP 2003244605 A * 8/2003
JP 2007-74622 A 3/2007
JP 2009210602 A * 9/2009

* cited by examiner

*Primary Examiner* — Sevan A Aydin
(74) *Attorney, Agent, or Firm* — IP Business Solutions, LLC

(57) ABSTRACT

The image forming apparatus includes: an openable/closable cover that is movable between a closed position in which the connection unit is covered and an open position in which the connection unit is exposed to the outside; and an interlocking mechanism that causes an on/off operation of a power switch and an opening/closing operation of the openable/closable cover to operate in conjunction with each other, wherein the interlocking mechanism moves the openable/closable cover from the open position to the closed position in conjunction with an off operation by which the power switch is switched from an on state to an off state, and the interlocking mechanism moves the openable/closable cover from the closed position to the open position in conjunction with an on operation by which the power switch is switched from the off state to the on state.

5 Claims, 6 Drawing Sheets

IMAGE FORMING APPARATUS

INCORPORATION BY REFERENCE

This application is based upon, and claims the benefit of priority from, corresponding Japanese Patent Application No. 2018-015087 filed in the Japan Patent Office on Jan. 31, 2018, the entire contents of which are incorporated herein by reference.

BACKGROUND

1. Field of the Invention

The present disclosure relates to an image forming apparatus.

2. Description of Related Art

Conventionally, an image forming apparatus including a connection unit for connecting a specific device on a side surface of the image forming apparatus main body is known.

SUMMARY

The present disclosure is directed to an image forming apparatus including a connection unit for connecting a specific device on a side surface of the image forming apparatus main body.

Further, the configuration of the present disclosure includes: an openable/closable cover that is movable between a closed position in which the connection unit is covered and an open position in which the connection unit is exposed to the outside; and an interlocking mechanism that causes an ON/OFF operation of a power switch and an opening/closing operation of the openable/closable cover to operate in conjunction with each other, wherein the interlocking mechanism moves the openable/closable cover from the open position to the closed position in conjunction with an OFF operation by which the power switch is switched from an ON state to an OFF state, and the interlocking mechanism moves the openable/closable cover from the closed position to the open position in conjunction with an ON operation by which the power switch is switched from the OFF state to the ON state.

DETAILED DESCRIPTION

Hereinafter, detail explanation is given of embodiments of the present disclosure with reference to the drawings. Note that the present disclosure is not limited to the following embodiments.

Embodiment 1

Figure 1:
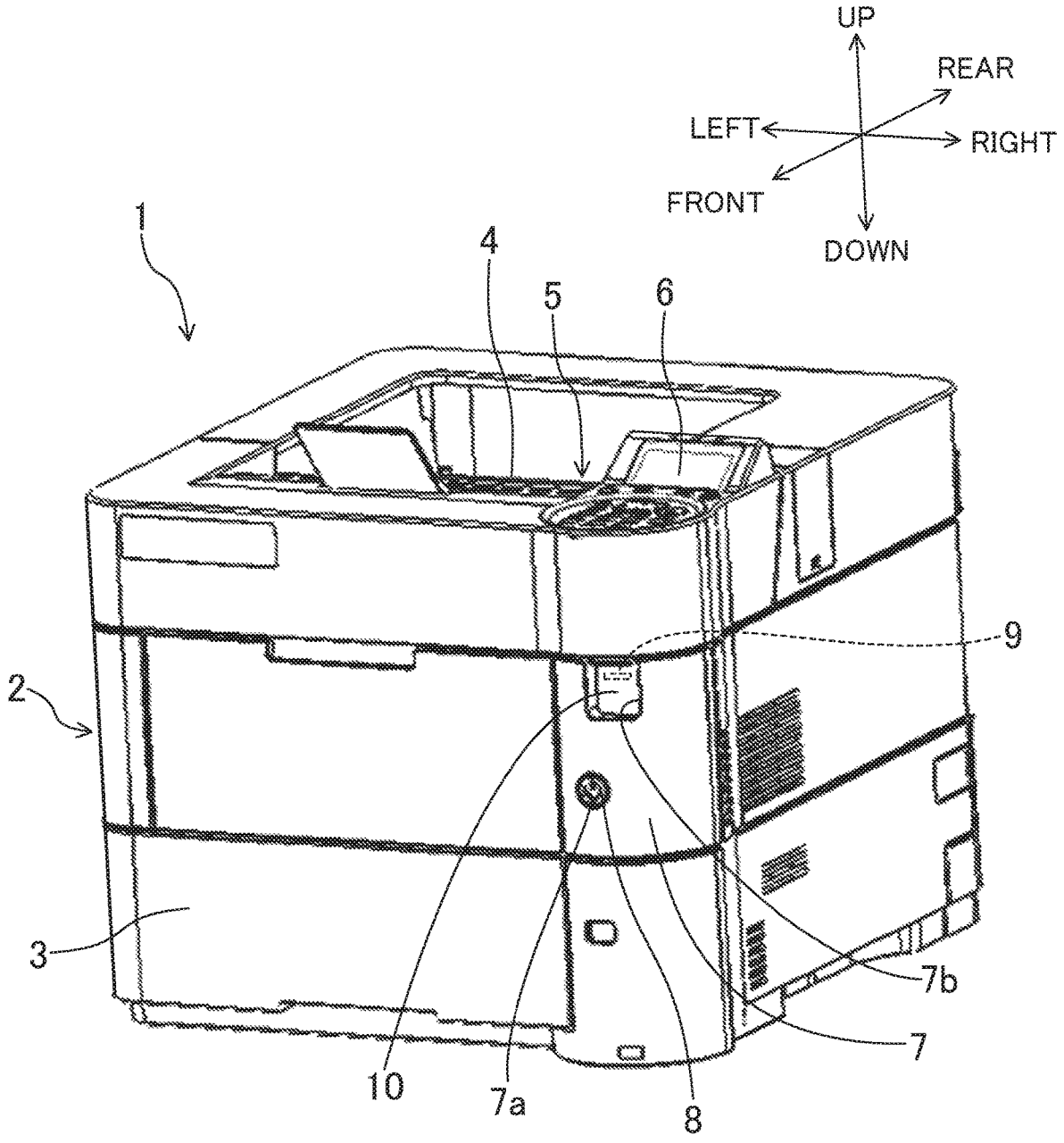
FIG. 1 is an external perspective view illustrating an image forming apparatus according to an embodiment.

FIG. 1 is an external perspective view illustrating an image forming apparatus 1 according to the present embodiment. Note that, in the following explanation, the front side and the rear side mean the front side and the rear side of the image forming apparatus 1, and the left side and the right side mean the left side and the right side of the image forming apparatus 1 when viewed from the front side.

The image forming apparatus 1 includes the image forming apparatus main body 2, and a sheet-feeding cassette 3 is attached to a lower portion of the image forming apparatus main body 2 in a drawable manner. In the sheet-feeding cassette 3, sheet-shape recording materials (e.g., paper or OHP sheets) are stacked and set in a bundle. An image forming unit and a fixing unit (none of which are illustrated) are accommodated in the space inside the image forming apparatus main body 2 above the sheet-feeding cassette 3. The image forming unit forms a toner image in an electrophotographic method on a recording material fed from the sheet-feeding cassette 3. The fixing unit fixes a toner image formed on a recording material by heat. The inside of the circumferential rim on the top surface of the image forming apparatus main body 2 is a paper-discharging tray unit 4 for discharging a recording material on which a fixing process has been completed. At the front right corner of the top surface of the image forming apparatus main body 2, there is provided an operation unit 5 for allowing a user to set printing conditions, to instruct start of printing, etc. On the rear side of the operation unit 5 on the top surface of the image forming apparatus main body 2, there is provided a display 6 for displaying various kinds of information.

The right end part of the front surface of the image forming apparatus main body 2 is covered with an exterior cover 7 made of resin. At the upper part of the exterior cover 7, there are formed a cylindrical hole 7*a* and a rectangular opening 7*b*. A power switch 8 is provided at a portion corresponding to the cylindrical hole 7*a* on the front surface of the image forming apparatus main body 2, and a USB port 9 is provided at a portion corresponding to the rectangular opening 7*b*.

The power switch 8 is exposed to an outside from the cylindrical hole 7*a* so as to allow a user to operate with his/her finger. The power switch 8 is a manual switch for switching between an ON state in which power is supplied to the image forming apparatus 1 and an OFF state in which power supply is cut off.

The USB port 9 is a connection unit to which a specific device such as a USB memory can be connected. By using the USB port 9, it is possible to directly transmit and receive printing data without using an external terminal such as a PC. The USB port 9 is positioned at the upper edge of the rectangular opening 7*b* when viewed from the front side. The outer edge of the USB port 9 is in a rectangular shape elongated in the left-right direction (i.e., specific direction).

The front side of the USB port 9 is covered with the openable/closable cover 10 in an openable and closable manner. The openable/closable cover 10 is configured to be movable in the up-down direction along the back surface (i.e., rear side surface) of the exterior cover 7.

Figure 2:
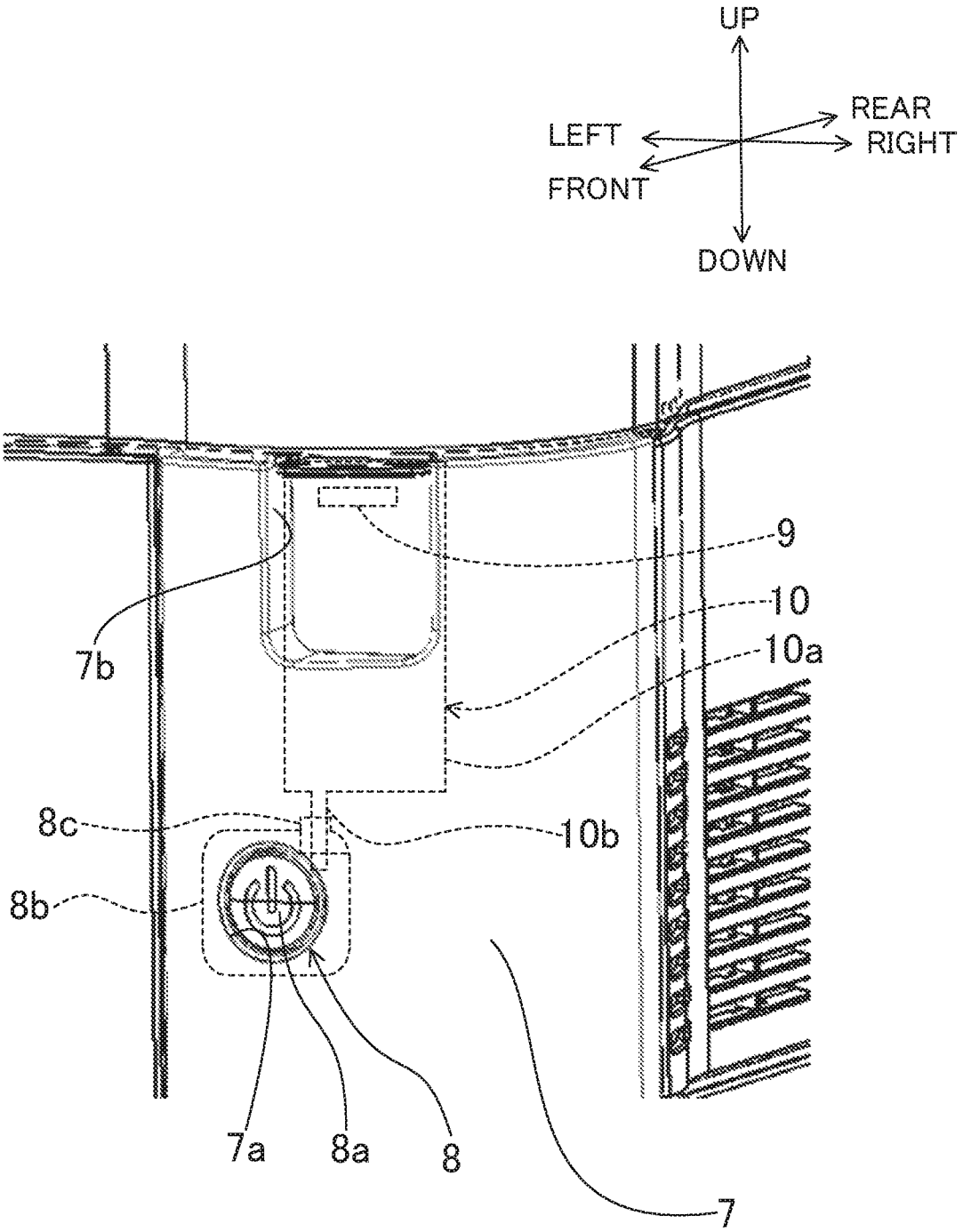
FIG. 2 is an enlarged perspective view illustrating an enlarged view of the periphery of a power switch and a USB port of the image forming apparatus.
Figure 3:
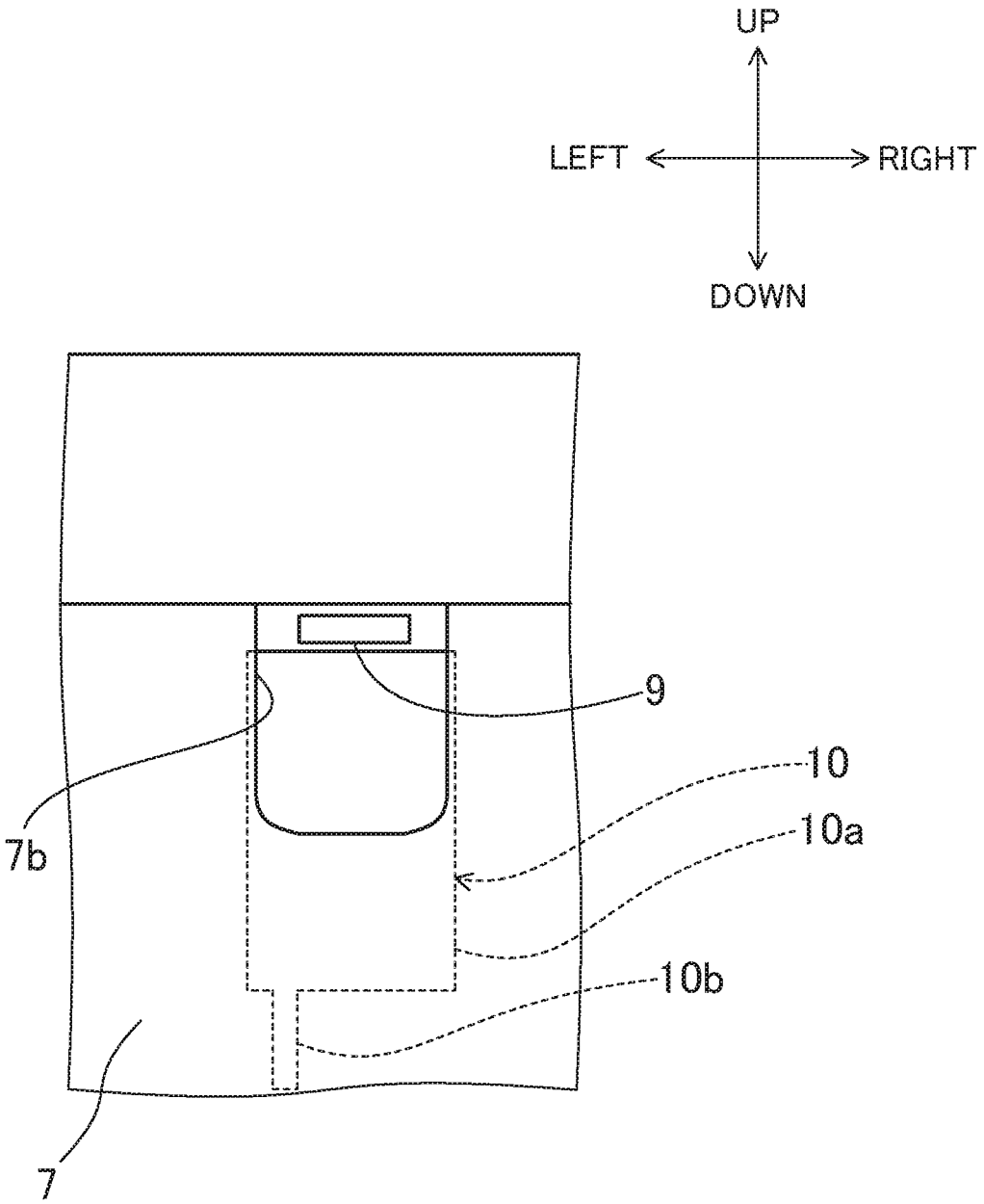
FIG. 3 is a schematic view of the periphery of the USB port as seen from the front side, in which an openable/closable cover is in an open position.

The openable/closable cover 10 is movable between a closed position in which the USB port 9 is covered from the front side and an open position in which the USB port 9 is exposed to the outside. The openable/closable cover 10 is moved downward from the closed position to the open position. When the openable/closable cover 10 is in the closed position, the rectangular opening 7*b* positioned on the front side of the USB port 9 is entirely closed by the openable/closable cover 10 (c.f., FIG. 1 and FIG. 2). On the other hand, when the openable/closable cover 10 is in the open position, the upper end part of the rectangular opening 7*b* is opened, so that the USB port 9 is entirely exposed to the outside from the opened part. When the openable/closable cover 10 is in the closed position, the USB port 9 is covered with the openable/closable cover 10 and can not be used. However, it is possible to prevent dust from entering the USB port 9. Since the USB port 9 is exposed to the outside from the rectangular opening 7*b* when the openable/closable cover 10 is in the open position, a user can connect a specific device such as a USB memory to the USB port 9.

Figure 4:
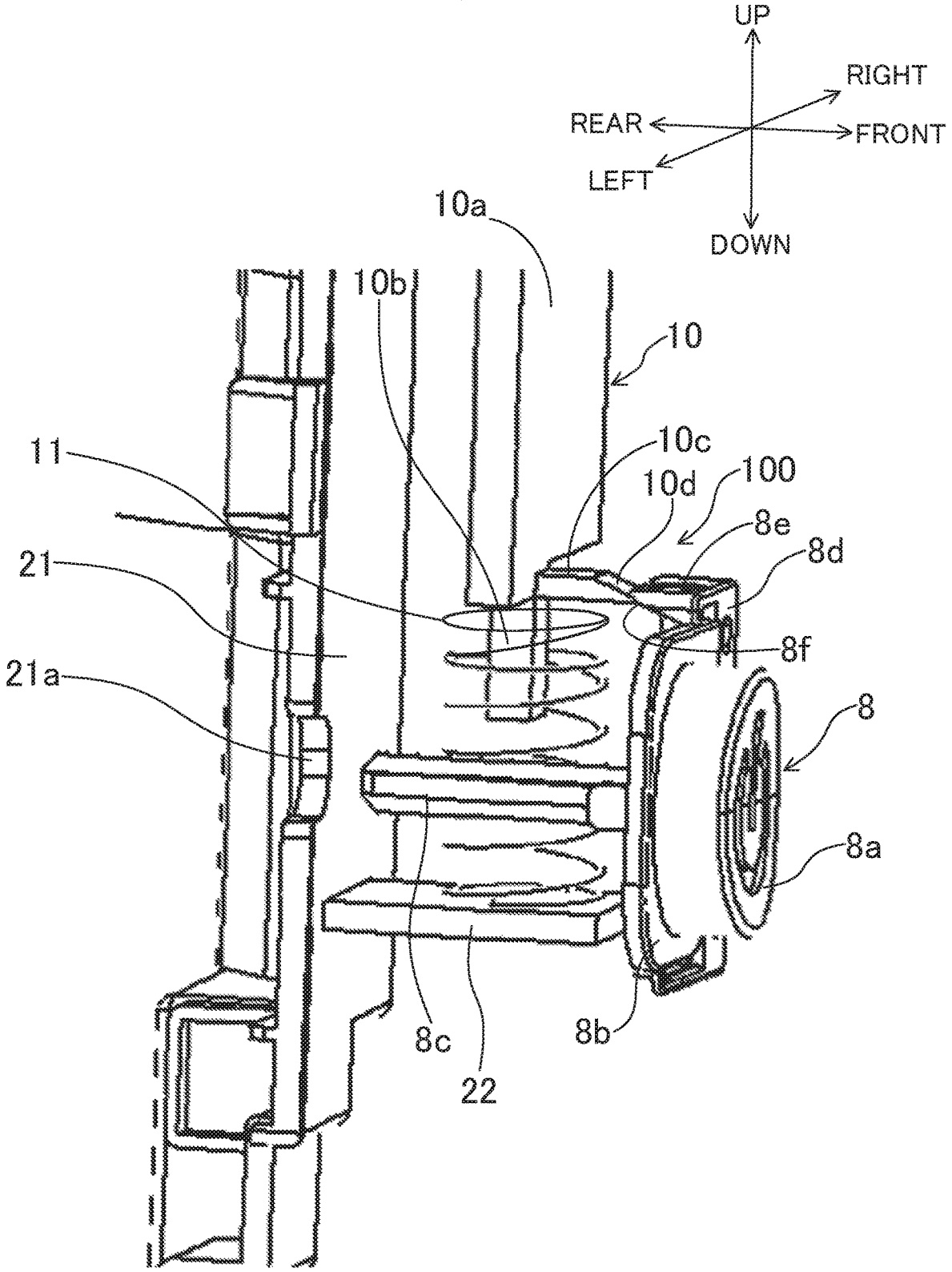
FIG. 4 is a perspective view illustrating an interlocking mechanism accommodated inside an exterior cover of the image forming apparatus, in which the openable/closable cover is in a closed position (i.e., in a state where the power switch is off)

The ON/OFF operation of the power switch 8 and the openable/closable operation of the openable/closable cover 10 are interlocked via the interlocking mechanism 100 (c.f., FIG. 4). The interlocking mechanism 100 includes: a driving inclined surface 8*f* provided in the power switch 8; and a driven inclined surface 10*d* provided in the openable/closable cover 10. The interlocking mechanism 100 causes the power switch 8 and the openable/closable cover 10 to operate in conjunction with each other by the wedge action of both inclined surfaces 8*f* and 10*d*.

Figure 5:
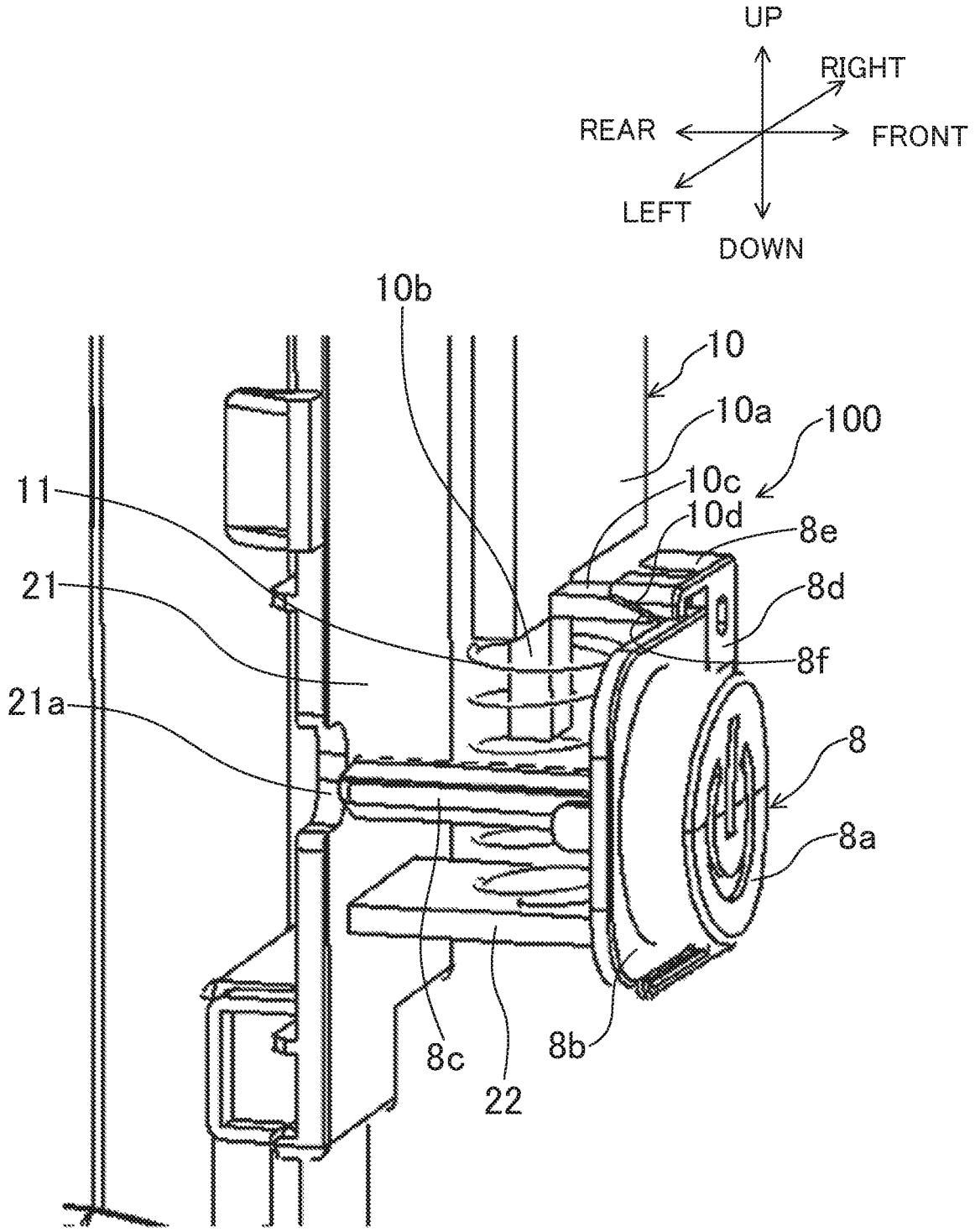
FIG. 5 is a perspective view illustrating the interlocking mechanism accommodated inside the exterior cover of the image forming apparatus, in which the openable/closable cover is in an open position (i.e., in a state where the power switch is on)
Figure 6:
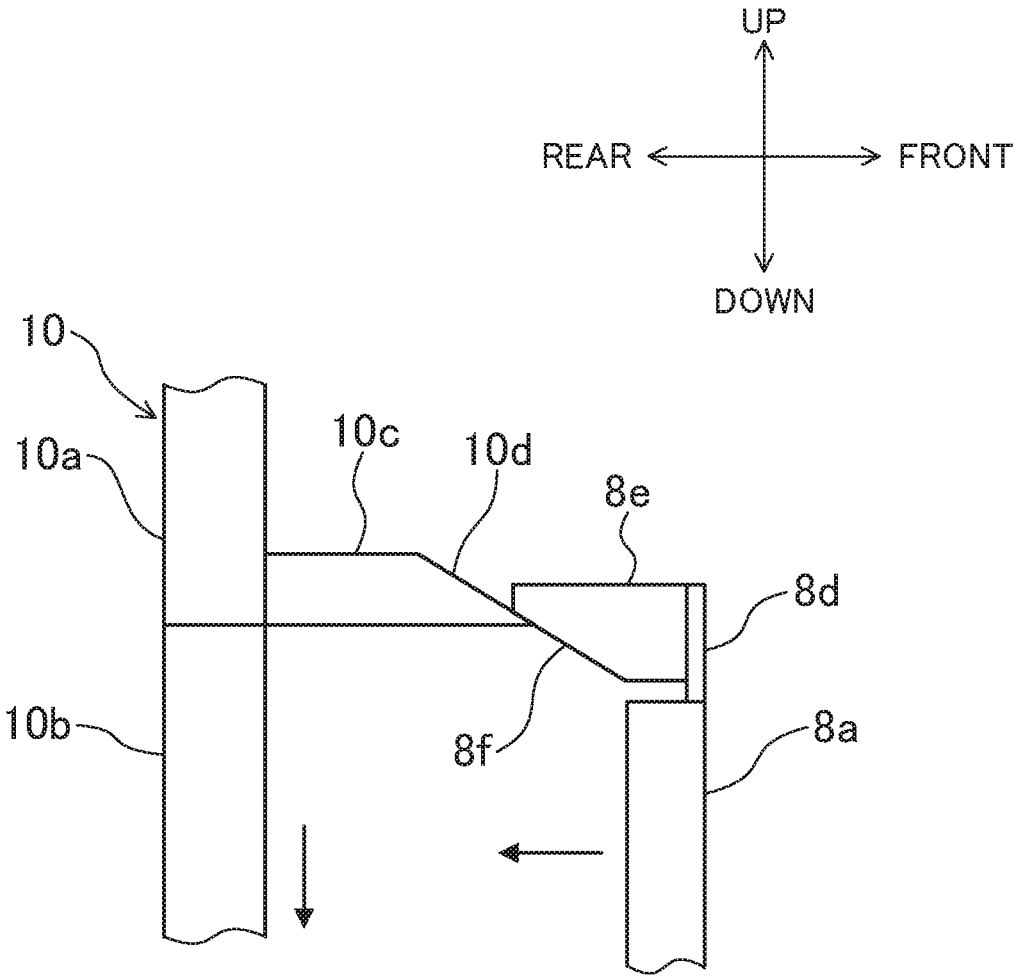
FIG. 6 is a schematic view illustrating an enlarged view of a contact part of a driving inclined surface provided in the power switch and a driven inclined surface provided in the openable/closable cover.

Hereinafter, with reference to FIG. 4 to FIG. 6, an explanation is given of more specific configurations of the power switch 8 and the openable/closable cover 10. Further, detail explanation is given of the interlocking mechanism 100. Note that, in FIG. 4 and FIG. 5, the exterior cover 7 is not illustrated for a better understanding of the configuration of the interlocking mechanism 100.

The power switch 8 is a push switch of an alternate operation type having a configuration in which, when a press operation (i.e., ON operation) is given in an OFF state, the power switch 8 is locked (or held) to an ON state by a mechanical lock mechanism (not illustrated), and, when a press operation (i.e., OFF operation) is given again in the ON state, the lock is released and the power switch 8 turns back to the OFF state.

The power switch 8 includes a press button 8*a* to be pressed as an operation by a user. The press button 8*a* is in a substantially cylindrical shape and arranged such that the thickness direction thereof corresponds to the front-rear direction. The press button 8*a* is fitted into the cylindrical hole 7*a* of the exterior cover 7.

The front end surface of the press button 8*a* is exposed to the outside from the cylindrical hole 7*a* of the exterior cover 7. When the power switch 8 is in the OFF state, the entire end surface of the press button 8*a* is at an OFF position, where the entire end surface of the press button 8*a* and the outer side surface of the exterior cover 7 make a flat surface. When the power switch 8 is switched to the ON state, the front end surface of the press button 8*a* is moved to the ON position slightly sunk rearside than the OFF position. (i.e., the position where the entire end surface of the press button 8*a* and the outer side surface of the exterior cover 7 make a flat surface).

The rear end surface of the press button 8*a* is fixed to the fixing plate part 8*b*. The fixing plate part 8*b* is in a substantially square shape. A press shaft part 8*c* is projecting from the center portion of the rear side surface of the fixing plate part 8*b*. When an ON operation is given to the press button 8*a*, the tip end of the press shaft part 8*c* is inserted into the through-hole 21*a* of the front side metal plate 21 of the image forming apparatus main body 2, so that the tip end makes contact with a switch element (not illustrated) provided inside and the power switch 8 is switched from the OFF state to the ON state.

An extension plate 8*d* (c.f., FIG. 6) extending upward is formed at the upper end part of the fixing plate part 8*b*. On the rear side surface of the extending plate 8*d*, a driving plate part 8*e* is projecting horizontally toward the rear side for driving the openable/closable cover 10 up and down. At the tip end part of the driving plate part 8*e*, there is formed a driving inclined surface 8*f* inclined rearward and upward. The driving inclined surface 8*f* is in contact with the driven inclined surface 10*d* provided to the openable/closable cover 10.

The openable/closable cover 10 includes a cover main body 10*a* (c.f., FIG. 4) in a rectangular plate-shape extending in the up-down direction. Both end surfaces in the width direction (i.e., left-right direction) of the cover main body 10*a* are guided by a pair of guide plates (not illustrated) projecting from the inner side surface of the exterior cover 7 so as to be movable in the up-down direction. The cover main body 10*a* is elastically supported from below by the biasing spring 11 in a coil shape.

On the lower end surface of the cover main body 10*a*, there is formed a spring insertion post 10*b* projecting downward. The spring insertion post 10*b* is inserted in the upper end portion of the biasing spring 11 described later.

On the front side surface of the lower end portion of the cover main body 10*a*, a driven plate portion 10*c* (c.f., FIG. 6) projecting horizontally toward the front side is provided. At the tip end portion of the driven plate portion 10*c*, there is formed a driven inclined surface 10*d* inclined downward and toward the front side. The inclination angle of the driven inclined surface 10*d* is the same as the inclination angle of the driving inclined surface 8*f*. The driven inclined surface 10*d* is in contact with the driving inclined surface 8*f*.

The biasing spring 11 is supported by a support plate portion 22 projecting horizontally from the front side metal plate 21 of the image forming apparatus main body 2. The biasing spring 11 is a helical compression spring which is expandable and contractible in the up-down direction and constantly biases the openable/closable cover 10 upward. The top surface of the support plate portion 22 is configured to be the bearing surface of the biasing spring 11. As described above, the spring insertion post 10*b* projecting from the lower end portion of the openable/closable cover 10 is inserted in the upper end portion of the biasing spring 11. Accordingly, the upper end portion of the biasing spring 11 is prevented from inclining outward in the radial direction relative to the lower end portion thereof and from falling off the support plate portion 22.

The interlocking mechanism 100 is configured with the driving inclined surface 8*f* of the power switch 8, the driven inclined surface 10*d* of the openable/closable cover 10, and the biasing spring 11.

Next, an explanation is given of the operation of the interlocking mechanism 100. FIG. 4 and FIG. 6 illustrate the power switch 8 in an OFF state. In this state, the openable/closable cover 10 is positioned at the closed position. The upper end portion of the driving inclined surface 8*f* of the power switch 8 is in contact with the lower end portion of the driven inclined surface 10*d* of the openable/closable cover 10.

When the press button 8*a* of the power switch 8 is pressed (i.e., ON operation) in this state to switch the power switch 8 to the ON state, the driving inclined surface 8*f* of the power switch 8 is moved toward the rear side while the driving inclined surface 8*f* is in contact with the driven inclined surface 10*d* of the openable/closable cover 10. Accordingly, the driven plate portion 10*c* is pushed downward by the wedge action of the driven inclined surface 10*d* and the driving inclined surface 8*f* As a result, the cover main body 10*a* connected to the driven plate portion 10*c* is pushed downward against the biasing force of the biasing spring 11 and moves to the open position (c.f., FIG. 5). Therefore, when the power switch 8 is in an ON state, the USB port 9 is exposed to the outside so that a specific device such as a USB memory can be inserted (used).

When the power switch 8 is pressed again, the press button 8*a* moves toward the front side and the power switch 8 is switched from the ON state to the OFF state. As the press button 8*a* moves toward the front side, the driving inclined surface 8*f* of the power switch 8 moves toward the front side while the driving inclined surface 8*f* is in contact with the driven inclined surface 10*d* of the openable/closable cover 10. As a result, the openable/closable cover 10 is pushed upward by the biasing force of the biasing spring 11 and returns to the closed position. When the openable/closable cover 10 returns to the closed position, the USB port 9 is covered with the openable/closable cover 10, so that it is possible to prevent dust from entering the USB port 9.

When the openable/closable cover 10 returns from the open position to the closed position (i.e., when the power switch 8 is switched from the ON state to the OFF state), there may be a case in which a specific device such as a USB memory is connected to the USB port 9. In this case, the cover main body 10*a* makes contact with the specific device and stops. Here, since the cover main body 10*a* is simply pushed upward by the biasing force of the biasing spring 11, excessive contact load is not applied to the specific device. Therefore, it is possible to prevent the specific device from being damaged by the contact load from the cover main body 10*a*.

As described above, the image forming apparatus 1 of the present embodiment includes: the openable/closable cover 10 movable between the closed position where the USB port 9 is covered and the open position where the USB port 9 is exposed to the outside; and the interlocking mechanism 100 that causes the ON/OFF operation of the power switch 8 and the opening/closing operation of the openable/closable cover 10 to operate in conjunction with each other. The interlocking mechanism 100 moves the openable/closable cover 10 from the open position to the closed position in conjunction with the OFF operation by which the power switch 8 is switched from the ON state to the OFF state, and, contrarily, the interlocking mechanism 100 moves the openable/closable cover 10 from the closed position to the open position in conjunction with the ON operation by which the power switch 8 is switched from the OFF state to the ON state.

According to the configuration, in a case where the power switch 8 is in the OFF state, in which the possibility that the USB port 9 is in use is low, the openable/closable cover 10 is driven by the interlocking mechanism 100 to the closed position, so that the USB port 9 is covered with the openable/closable cover 10. Contrarily, in a case where the power switch 8 is in the ON state, in which the possibility that the USB port 9 is in use is high, the openable/closable cover 10 is driven by the interlocking mechanism 100 to the open position, so that the USB port 9 is exposed to the outside to become usable. Therefore, it is possible to prevent dust from entering the USB port 9 because of unnecessarily often exposure of the USB port 9 to the outside. Further, in conjunction with the ON/OFF operation of the power switch 8, opening and closing of the openable/closable cover 10 is automatically performed by the interlocking mechanism 100. Therefore, for connecting and disconnecting the USB port 9, a user does not need to be conscious of opening and closing of the openable/closable cover 10. Therefore, it is possible to prevent dust from entering the USB port 9 without imparting troublesome feeling to the user.

Further, in the present embodiment, the interlocking mechanism 100 includes a biasing spring 11 that biases the openable/closable cover 10 from the open position side to the closed position side, and, upon an OFF operation of the power switch 8, the openable/closable cover 10 is driven from the open position to the closed position by the biasing force of the biasing spring 11.

Accordingly, the movement of the openable/closable cover 10 from the open position to the closed position side is performed simply by the biasing spring 11 without using an actuator such as a motor. Therefore, when the openable/closable cover 10 is moved from the open position to the closed position side, even if the openable/closable cover 10 makes contact with a specific device (e.g., USB memory) that is kept connected to the USB port 9, it is possible to prevent an excessive contact load from acting on the specific device. Therefore, it is possible to prevent the specific device from being damaged by the contact load caused by the openable/closable cover 10. In addition, when it is desired to detach the specific device, the openable/closable cover 10 can simply pushed down by hand against the biasing force of the biasing spring 11. Therefore, the specific device cannot be detachable by the openable/closable cover 10 making contact with the specific device.

Further, in the present embodiment, the power switch 8 is a push-type switch that is pushed for switching between the ON state and the OFF state, and the interlocking mechanism 100 includes the driving inclined surface 8*f* which is provided in the power switch 8 and the driven inclined surface 10*d* which is provided in the openable/closable cover 10 and configured to make contact with the driving inclined surface 8*f* The driving inclined surface 8*f* is inclined relative to a pushing direction (i.e., front-rear direction) of the power switch 8 toward an orthogonal direction (i.e., up-down direction) orthogonal to the pushing direction. Further, the interlocking mechanism 100 is configured to drive the openable/closable cover 10 by the wedge action of the driving inclined surface 8*f* and the driven inclined surface 10*d*.

According to this configuration, the interlocking mechanism 100 can be configured with a simple configuration without using an electric actuator such as a motor. Therefore, it is possible to reduce the cost required for providing the interlocking mechanism 100.

Further, in the present embodiment, the USB port 9 is in a rectangular shape whose outer rim is elongated in the left-right direction when seen from the direction orthogonal to the side surface of the image forming apparatus main body 2, and the short direction orthogonal to the longitudinal direction of the USB port 9 corresponds to the height direction (i.e., the orthogonal direction) of the driving inclined surface 8*f*.

Accordingly, the movement amount of the openable/closable cover 10 required for exposing the USB port 9 can be reduced. Therefore, it is not necessary to enlarge dimensions in the height direction of the driving inclined surface 8*f* and the driven inclined surface 10*d* for securing the movement amount of the openable/closable cover 10. Accordingly, the dimensions of the interlocking mechanism 100 in the height direction can be kept small so as to improve the space efficiency.

Further, in the present embodiment, the power switch 8 is a push switch of an alternate operation type having the press button 8*a* that can be pushed by a user. Further, the press button 8*a* is locked at the OFF position in the OFF state, and the press button 8*a* is locked at the ON position, the push button is locked at the ON position where the push button is sunk below the OFF position, in the ON state.

Accordingly, the openable/closable cover 10 can be held (or locked) at the open position or the closed position by the alternate operation of the power switch 8. Therefore, it is not necessary to additionally provide a mechanism for keeping the openable/closable cover 10 at the open position or the closed position after the power switch 8 is turned on or off. It is possible to further reduce the cost required for providing the interlocking mechanism 100.

Other Embodiments

The above embodiment 1 of the present disclosure may be configured as follows.

In the above embodiment, an explanation has been given with the USB port 9 as an example of the connection unit. However, the connection unit is not limited to the USB port 9, but may be a LAN port, etc.

In the above embodiment, the interlocking mechanism 100 is configured only with a mechanical mechanism. However, the interlocking mechanism 100 is not limited to the above configuration That is, the interlocking mechanism 100 may be configured with: an electric actuator for driving the openable/closable cover 10; and a control unit for controlling the electric actuator in conjunction with the ON/OFF operation of the power switch 8.

In the above embodiment, explanation has been given with a printer as an example of the image forming apparatus 1. However, the image forming apparatus 1 is not limited to a printer. That is, the image forming apparatus 1 may be a copier, a facsimile, a multifunction peripheral (MFP), etc.

As described above, the present disclosure is beneficial for an image forming apparatus, and is particularly beneficial for a copier, a printer, a facsimile, a multifunction peripheral (MFP), etc.

What is claimed is:

1. An image forming apparatus including an image forming apparatus main body and a connection unit for connecting a specific device on a side surface of the image forming apparatus, the image forming apparatus comprising:

an openable/closable cover that is movable between a closed position in which the connection unit is covered and an open position in which the connection unit is exposed to an outside; and an interlocking mechanism that causes an ON/OFF operation of a power switch and an opening/closing operation of the openable/closable cover to operate in conjunction with each other, wherein the interlocking mechanism moves the openable/closable cover from the open position to the closed position in conjunction with an OFF operation by which the power switch is switched from an ON state to an OFF state, and the interlocking mechanism moves the openable/closable cover from the closed position to the open position in conjunction with an ON operation by which the power switch is switched from the OFF state to the ON state.

2. The image forming apparatus according to claim 1, wherein the interlocking mechanism includes a biasing spring that biases the openable/closable cover from an open position side to a closed position side, and, upon the OFF operation of the power switch, the interlocking mechanism drives the openable/closable cover from the open position to the closed position side by a biasing force of the biasing spring.

3. The image forming apparatus according to claim 1, wherein the power switch is a push-type switch that is pushed for switching between the ON state and the OFF state, and the interlocking mechanism drives the openable/closable cover by a wedge action of a driving inclined surface and a driven inclined surface, the driving inclined surface being provided in the power switch and inclined relative to a pushing direction of the power switch toward an orthogonal direction orthogonal to the pushing direction, the driven inclined surface being provided in the openable/closable cover and configured to make contact with the driving inclined surface.

4. Image forming apparatus according to claim 3, wherein the connection unit is in a shape whose outer rim is elongated in a specific direction when seen from a direction orthogonal to the side surface of the image forming apparatus main body, and a short direction orthogonal to a longitudinal direction of the connection unit corresponds to the orthogonal direction.

5. The image forming apparatus according to claim 1, wherein the power switch is a push switch of an alternate operation type having a pressing button that can be pushed by a user, and the pressing button is locked at an OFF position in the OFF state, and the push button is locked at the ON position where the push button is sunk below the OFF position, in the ON state.

* * * * *